US009638005B2

(12) United States Patent
Howell et al.

(10) Patent No.: US 9,638,005 B2
(45) Date of Patent: May 2, 2017

(54) COMBINED ANTI-ROTATION APPARATUS AND PRESSURE TEST TOOL

(71) Applicants: David A. Howell, Houston, TX (US); John M. Lynk, Houston, TX (US); Bill B. Blatnick, Trinidad, CO (US)

(72) Inventors: David A. Howell, Houston, TX (US); John M. Lynk, Houston, TX (US); Bill B. Blatnick, Trinidad, CO (US)

(73) Assignee: ExxonMobil Upstream Research Company, Spring, TX (US)

( * ) Notice: Subject to any disclaimer, the term of this patent is extended or adjusted under 35 U.S.C. 154(b) by 460 days.

(21) Appl. No.: 14/264,941

(22) Filed: Apr. 29, 2014

(65) Prior Publication Data

US 2014/0367093 A1 Dec. 18, 2014

Related U.S. Application Data

(60) Provisional application No. 61/834,307, filed on Jun. 12, 2013, provisional application No. 61/914,721, filed on Dec. 11, 2013.

(51) Int. Cl.

| | |
|---|---|
| ***E21B 34/14*** | (2006.01) |
| ***E21B 47/06*** | (2012.01) |
| ***E21B 43/12*** | (2006.01) |

(52) U.S. Cl.

CPC ..... *E21B 34/14* (2013.01); *E21B 43/129* (2013.01); *E21B 47/06* (2013.01)

(58) Field of Classification Search

CPC ..... E21B 34/12; E21B 47/1025; E21B 34/14; E21B 43/129; E21B 47/06

See application file for complete search history.

(56) References Cited

U.S. PATENT DOCUMENTS 3,863,719 A * 2/1975 Parker ..... E21B 23/006 166/128
4,083,230 A 4/1978 Rome, Sr. et al.
(Continued)

FOREIGN PATENT DOCUMENTS

GB 2 248 465 A 4/1992
GB 2 412 133 B 9/2005
(Continued)

*Primary Examiner* — Brad Harcourt
(74) *Attorney, Agent, or Firm* — ExxonMobil Upstream Research Company-Law Department

(57) ABSTRACT

A down-hole tool for pressure testing production tubing within a borehole of a well returning the well to production, includes an anti-rotational device comprising a tubular housing having a first end, a second end, an outer surface, and at least one anti-rotational wing disposed on the outer surface of the tubular housing, radially extendable to engage a radial surface of the borehole to anchor the production tubing thereto; a valve for controlling the flow of down-hole fluids within the production tubing, the valve comprising a first valve member fixedly positioned within the tubular housing of the anti-rotational device and a second valve member positionable between a closed position and an open position; and a reactivation device comprising means for axially engaging an axial surface of the borehole, the reactivation device affixed to the first end of the tubular housing, wherein the production tubing may be pressure tested when the valve is in the closed position.

21 Claims, 8 Drawing Sheets

(56) References Cited

U.S. PATENT DOCUMENTS

| | | | | |
|---|---|---|---|---|
| 4,694,903 | A | 9/1987 | Ringgenberg | |
| 4,846,272 | A | 7/1989 | Leggett | |
| 5,482,119 | A | 1/1996 | Manke et al. | |
| 5,549,160 | A | 8/1996 | Bownes et al. | |
| 7,716,979 | B1 | 5/2010 | Abshire | |
| 8,316,951 | B2 | 11/2012 | Fay et al. | |
| 2004/0035199 | A1 | 2/2004 | Meister et al. | |
| 2008/0001111 | A1 | 1/2008 | Ross | |
| 2008/0029265 | A1* | 2/2008 | LaClare | E21B 23/01 166/217 |
| 2008/0202748 | A1* | 8/2008 | Bussear | E21B 43/128 166/264 |
| 2009/0065213 | A1 | 3/2009 | Burnett | |
| 2009/0078426 | A1 | 3/2009 | Blaquiere | |
| 2009/0136371 | A1 | 5/2009 | Gerling | |
| 2010/0252277 | A1 | 10/2010 | Gette | |
| 2010/0326664 | A1 | 12/2010 | Neto et al. | |
| 2011/0240306 | A1 | 10/2011 | Neto | |
| 2012/0237380 | A1 | 9/2012 | Robles-Villa | |

FOREIGN PATENT DOCUMENTS

| | | |
|---|---|---|
| GB | 2 411 683 B | 10/2005 |
| GB | 2 418 693 B | 10/2006 |

* cited by examiner

COMBINED ANTI-ROTATION APPARATUS AND PRESSURE TEST TOOL

CROSS REFERENCE TO RELATED APPLICATIONS

This application claims the benefit of U.S. Provisional No. 61/834,307, filed Jun. 12, 2013, and U.S. Provisional No. 61/914,721, filed Dec. 11, 2013, the contents of both are hereby incorporated by reference in their entirety.

FIELD

The present disclosure relates to an apparatus for and a method of pressure testing production tubing within a borehole of a well and returning the well to production.

BACKGROUND

A progressive cavity pump (PCP) is a device used to enable artificial lift for hydrocarbon production. A PCP has a rotor and a stator that go inside a production tubing. A motor at the top of the well turns a rod string, which turns the rotor at the bottom of the well, which makes a progressing cavity that pulls fluid in from the below the stator and pushes it out above the stator. Two problems with PCP's are that 1) they can create wear on production tubing, which necessitates pressure tests; and 2) they can cause lower joints of tubing to become loosened or disconnected.

PCP rotor rods routinely cause significant wear on the inner diameter of the production tubing string, potentially leading to tubing leaks. If the rod has eccentricity, it can rub against the inside of the production tubing and create wear spots, especially at rod joint connections.

Pressure tests are required to ensure the integrity of the production tubing prior to operation, and during the life of the well. One current method of practice is to run the tubing in hole with a bull plug, conduct a pressure test, pull the tubing out of hole, replace the bull plug with the stator, run in hole with the tubing for a second time, and then run in hole with the rotor. Every time that the tubing is re-tested, the rotor and tubing have to be pulled out of hole and the operation is repeated with this current practice.

When a progressive cavity pump is operating, there is a risk that it can cause joints of tubing to "back out." That is, the tubing joints may become loosened or disconnected and compromise the integrity of the well.

Such a situation may occur when the stator elastomer becomes compromised due to normal well operating conditions (temperature, solubility, use, etc.). Instead of moving independently of the stator, the rotor becomes enmeshed with the stator. Due to continued torque from the motor at the wellhead, the stator begins moving with the rotor. Viewing this situation from the top of the well, down, the rotor rods, rotor, stator, and possibly a few production tubing joints above the stator all rotating clockwise. As may be appreciated, clockwise rotation of a lower joint produces the same result as counter-clockwise rotation of an upper joint, in that counter-clockwise rotation of an upper joint disconnects production tubing joints. As may be appreciated, when the production tubing joints are disconnected, well integrity is compromised, and this can lead to well failure.

While there exists certain existing technology to prevent stators and production tubing from backing out, what is needed is the ability to combine this feature with a pressure test valve.

SUMMARY

In one aspect, provided is a down-hole tool for pressure testing production tubing within a borehole of a well and returning the well to production. The down-hole tool includes an anti-rotational device comprising a tubular housing having a first end, a second end, an outer surface, and at least one anti-rotational wing disposed on the outer surface of the tubular housing, the at least one anti-rotational wing radially extendable to engage a radial surface of the borehole to anchor the production tubing thereto; a valve for controlling the flow of down-hole fluids within the production tubing, the valve comprising a first valve member fixedly positioned within the tubular housing of the anti-rotational device and a second valve member positionable between a closed position and an open position; and a reactivation device comprising means for axially engaging an axial surface of the borehole, the reactivation device affixed to the first end of the tubular housing, wherein the production tubing may be pressure tested when the valve is in the closed position.

In some embodiments, the second valve member is positioned adjacent the second end of the tubular housing.

In some embodiments, the anti-rotational device and valve are integrated to form a single down-hole tool.

In some embodiments, the down-hole tool also includes a plurality of anti-rotational wings disposed on the outer surface of the tubular housing.

In some embodiments, the plurality of anti-rotational wings are substantially equally spaced about the outer surface of the tubular housing.

In some embodiments, the plurality of anti-rotational wings are biased to extend the plurality of anti-rotational wings to engage the radial surface of the borehole.

In some embodiments, the anti-rotational device includes a gear mechanism structured and arranged to extend the plurality of anti-rotational wings to engage the radial surface of the borehole.

In some embodiments, the down-hole tool is attached to a stator of a progressive cavity pump.

In some embodiments, the down-hole tool is attached to a non-perforated tubular extension, the non-perforated tubular extension attached to the bottom of the stator of a progressive cavity pump.

In some embodiments, the valve for controlling the flow of down-hole fluids of the down-hole tool is rotated to place the valve in a closed position.

In some embodiments, the valve for controlling the flow of down-hole fluids of the down-hole tool is rotated in an opposite direction from that employed to close the valve to place the valve in an open position.

In some embodiments, the valve for controlling the flow of down-hole fluids employs a metal-to-metal seal. In some embodiments, the valve for controlling the flow of down-hole fluids employs an O-ring seal or seals of material other than metal.

In some embodiments, the means for axially engaging an axial surface of the borehole of the reactivation device comprises a plurality of teeth for engaging bottom-hole cement.

In another aspect, provided is a method for pressure testing production tubing within a borehole of a well and returning the well to production. The method includes the steps of: (a) installing a production tubing string within a borehole of a well, the tubing string comprising a down-hole tool positioned adjacent a distal end of a production tubing string, the down-hole tool comprising: (i) an anti-rotational device comprising a tubular housing having a first end, a second end, an outer surface and at least one anti-rotational wing disposed on the outer surface, the at least one anti-rotational wing radially extendable to engage a radial surface of the borehole to anchor the production tubing thereto; (ii) a valve for controlling the flow of down-hole fluids within the production tubing, the valve comprising a first valve member fixedly positioned within the tubular housing of the anti-rotational device and a second valve member positionable between a closed position and an open position; and (iii) a reactivation device comprising means for axially engaging an axial surface of the borehole, the reactivation device affixed to the first end of the tubular housing; (b) conducting a pressure test of the production tubing string; and (c) returning the well to production upon verifying tubing integrity.

In some embodiments, step (c) further includes the steps of: (i) rotating the down-hole tool to extend the at least one wing and engage a radial surface of the borehole to anchor the production tubing thereto; and (ii) rotating the down-hole tool to open the valve to allow production fluids to flow from the distal end to the proximal end of the production tubing string.

In some embodiments, the following steps are conducted prior to conducting step (b): (i) rotating the down-hole tool to retract the at least one wing and disengage the radial surface of the borehole; (ii) lowering the production tubing string to engage the reactivation device with an axial surface of the borehole, and (ii) rotating the down-hole tool to close the valve to seal the production tubing string from production fluids.

In some embodiments, the second valve member is positioned adjacent the second end of the tubular housing.

In some embodiments, the valve for controlling the flow of down-hole fluids employs a metal-to-metal seal. In some embodiments, the valve for controlling the flow of down-hole fluids employs an O-ring seal or seals of material other than metal.

In some embodiments, the anti-rotational device further comprises a plurality of anti-rotational wings disposed on the outer surface of the tubular housing.

In some embodiments, the plurality of anti-rotational wings are substantially equally spaced about the outer surface of the tubular housing.

In some embodiments, the plurality of anti-rotational wings are biased to extend the plurality of anti-rotational wings to engage the radial surface of the borehole.

In some embodiments, the anti-rotational device further comprises a gear mechanism structured and arranged to extend the plurality of anti-rotational wings to engage the radial surface of the borehole.

In some embodiments, the down-hole tool is attached to a stator of a progressive cavity pump.

In some embodiments, the down-hole tool is attached to a non-perforated tubular extension, the non-perforated tubular extension attached to the bottom of the stator of a progressive cavity pump.

In some embodiments, the means for axially engaging an axial surface of the borehole of the reactivation device comprises a plurality of teeth for engaging bottom-hole cement.

In some embodiments, the anti-rotational device and valve are integrated to form a single down-hole tool.

In some embodiments, the anti-rotational device and valve form an assembly.

DETAILED DESCRIPTION

FIGS. 1-13 provide illustrative, non-exclusive examples of a down-hole tool for pressure testing production tubing, according to the present disclosure and/or of systems, apparatus, and/or assemblies that may include, be associated with, be operatively attached to, and/or utilize such systems. In FIGS. 1-13, like numerals denote like, or similar, structures and/or features; and each of the illustrated structures and/or features may not be discussed in detail herein with reference to each of FIGS. 1-13. Similarly, each structure and/or feature may not be explicitly labeled in each of FIGS. 1-13; and any structure and/or feature that is discussed herein with reference to any one of FIGS. 1-13 may be utilized with any other of FIGS. 1-13 without departing from the scope of the present disclosure.

In general, structures and/or features that are, or are likely to be, included in a given embodiment are indicated in solid lines in FIGS. 1-13, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Figure 1:
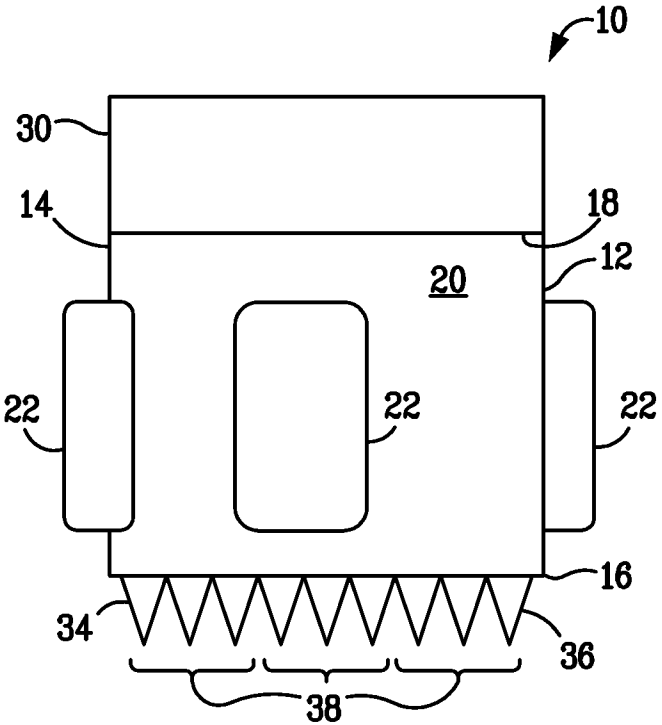
FIG. 1 presents a plan view of an illustrative example of a down-hole tool for pressure testing production tubing, in pressure test mode, according to the present disclosure.

Referring now to FIG. 1, a plan view of an illustrative example of a down-hole tool for pressure testing production tubing 10 is presented and shown in a pressure test mode. The down-hole tool for pressure testing production tubing 10 includes an anti-rotational device 12. Anti-rotational device 12 includes a tubular housing 14 having a first end 16, a second end 18 and an outer surface 20. At least one anti-rotational wing 22 is disposed on the outer surface 20 of the tubular housing 14, the at least one anti-rotational wing radially extendable to engage a radial surface of the borehole to anchor the production tubing thereto. In some embodiments, the at least one anti-rotational wing 12 may be provided with a plurality of casing teeth (not shown) to grip a casing when installed therein. In some embodiments, the at least one anti-rotational wing 22 is biased to extend the at least one anti-rotational wing 22 to engage a radial surface of the borehole.

Figure 4:
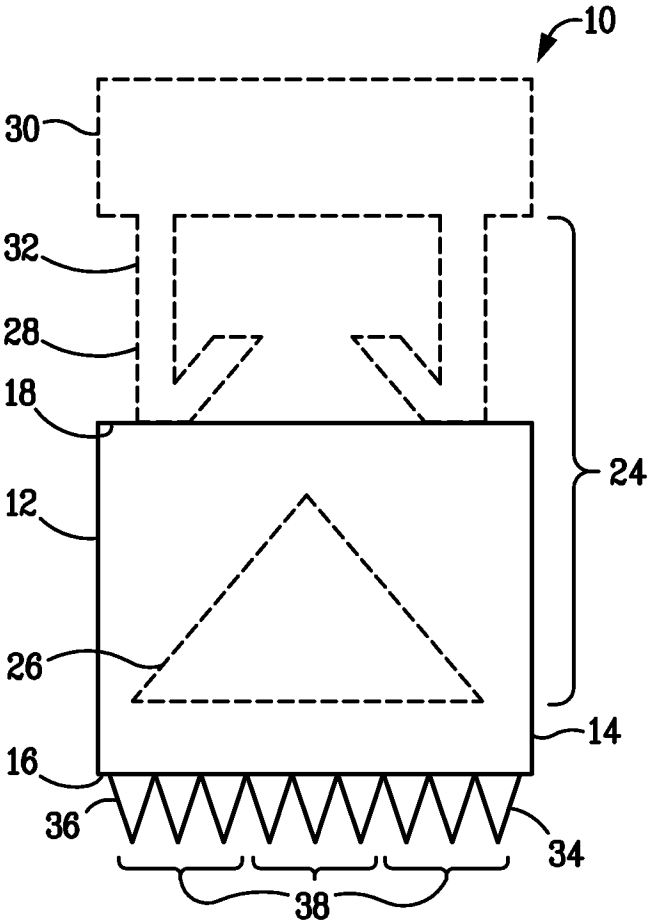
FIG. 4 presents a plan view of an illustrative example of a down-hole tool for pressure testing production tubing, schematically depicting an internal valve in production and anti-rotation mode, according to the present disclosure.
Figure 3:
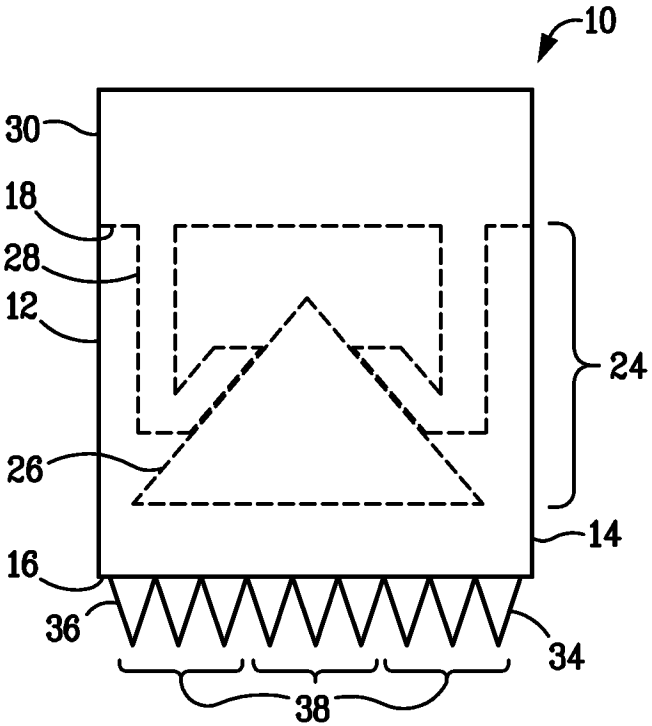
FIG. 3 presents a plan view of an illustrative example of a down-hole tool for pressure testing production tubing, schematically depicting an internal valve in pressure test mode, according to the present disclosure.

Referring now to FIGS. 3 and 4, the anti-rotational device 12 may also include a valve 24 for controlling the flow of down-hole fluids within the production tubing. Valve 24 includes a first valve member 26 fixedly positioned within the tubular housing 14 of the anti-rotational device 12 and a second valve member 28 positionable between a closed position (see FIG. 3) and an open position (see FIG. 4). In some embodiments, the second valve member 28 is positioned adjacent the second end 18 of the tubular housing 14.

Figure 2:
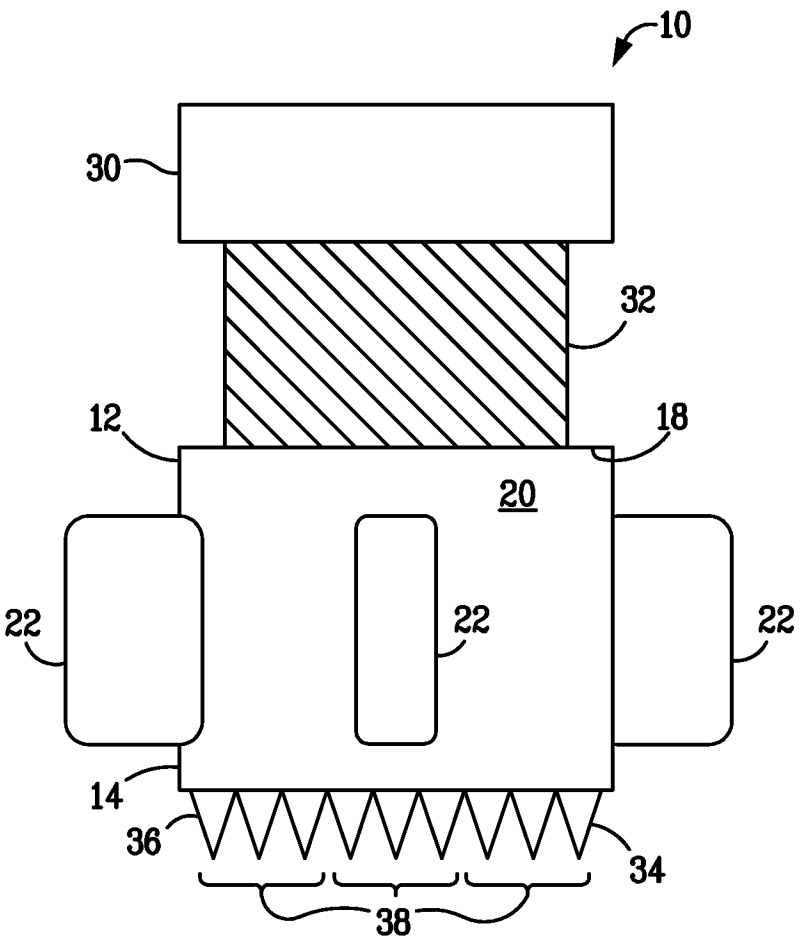
FIG. 2 presents a plan view of an illustrative example of a down-hole tool for pressure testing production tubing, shown in production and anti-rotation mode, according to the present disclosure.

Referring now to FIG. 2, a plan view of an illustrative example of down-hole tool 10 for pressure testing production tubing is shown in production and anti-rotation mode. Referring also to FIGS. 3 and 4, in some embodiments, valve 24 is activated and deactivated by rotating a threaded valve housing 30, threaded valve housing 30 provided with an external threaded section 32 for mating with an internal threaded section (not shown) of tubular housing 14. As may be appreciated, production tubing may be pressure tested when the valve 24 is in the closed position, as shown in FIG. 3.

Referring again to FIGS. 1 and 2, in some embodiments, the anti-rotational device 12 and valve 24 are integrated to form a single down-hole tool 10. In some embodiments, a plurality of anti-rotational wings 22 are disposed on the outer surface 20 of the tubular housing 14. In some embodiments, the plurality of anti-rotational wings 22 are substantially equally spaced about the outer surface 20 of the tubular housing 14.

Referring still to FIGS. 1-4, a reactivation device 34 may be provided with means for axially engaging an axial surface of the borehole 36, the reactivation device 34 affixed to the first end 16 of the tubular housing 14. In some forms, the means for axially engaging an axial surface of the borehole 36 of the reactivation device 34 comprises a plurality of teeth 38 for engaging bottom-hole cement.

Figure 5:
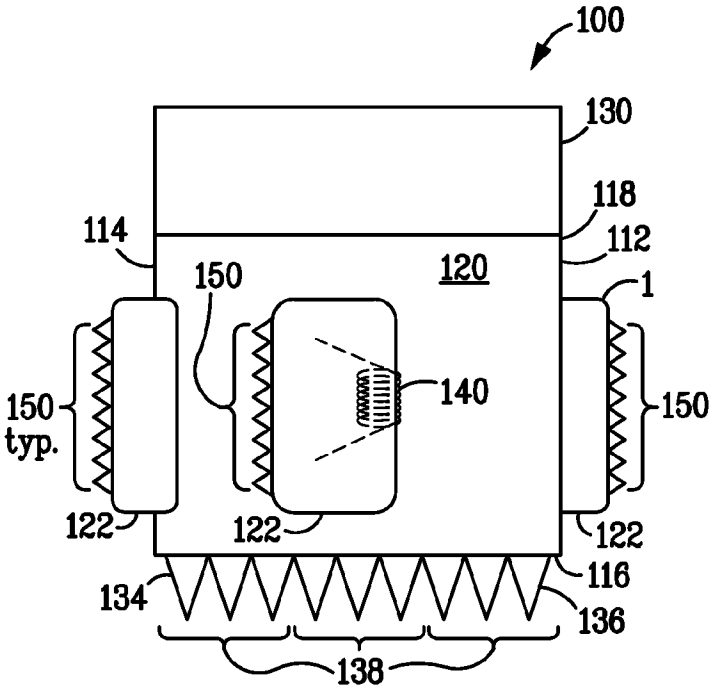
FIG. 5 presents a plan view of an illustrative example of a spring-loaded down-hole tool for pressure testing production tubing, in pressure test mode, according to the present disclosure.

FIG. 5 presents a plan view of an illustrative example of a spring-loaded down-hole tool 100 for pressure testing production tubing, in pressure test mode. The down-hole tool for pressure testing production tubing 100 includes an anti-rotational device 112. Anti-rotational device 112 includes a tubular housing 114 having a first end 116, a second end 118 and an outer surface 120. At least one anti-rotational wing 122 is disposed on the outer surface 120 of the tubular housing 114, the at least one anti-rotational wing radially extendable to engage a radial surface of the borehole to anchor the production tubing thereto. As shown, the at least one anti-rotational wing 122 may be provided with a plurality of casing teeth 150 to grip a casing when installed therein.

Referring also to FIGS. 3 and 4, a valve 24 for controlling the flow of down-hole fluids within the production tubing may be provided. Valve 24 includes a first valve member 26 fixedly positioned within the tubular housing 114 of the anti-rotational device 112 and a second valve member 28 positionable between a closed position (see FIG. 3) and an open position (see FIG. 4). In some embodiments, the second valve member 28 is positioned adjacent the second end 118 of the tubular housing 114.

Figure 6:
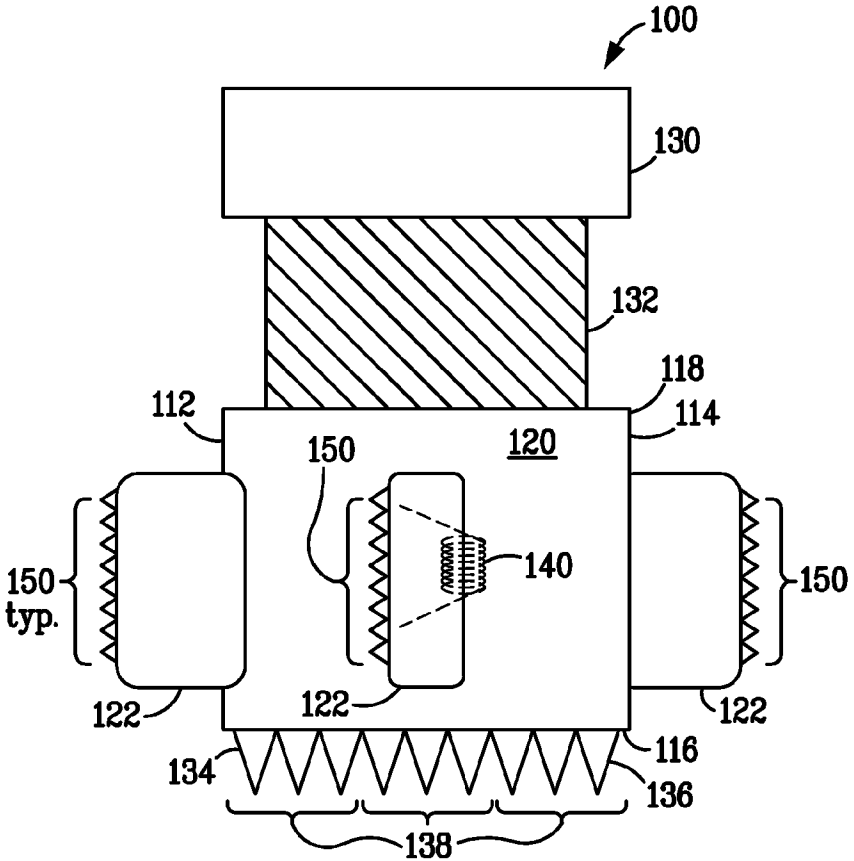
FIG. 6 presents a plan view of an illustrative example of a spring-loaded down-hole tool for pressure testing production tubing, shown in production and anti-rotation mode, according to the present disclosure.

Referring now to FIG. 6 a plan view of an illustrative example of the spring-loaded down-hole tool 110 for pressure testing production tubing is shown in production and anti-rotation mode. Referring also to FIGS. 3 and 4, in some embodiments, valve 24 is activated and deactivated by rotating a threaded valve housing 130, threaded valve housing 130 provided with an external threaded section 132 for mating with an internal threaded section (not shown) of tubular housing 114. As may be appreciated, production tubing may be pressure tested when the valve 24 is in the closed position, as shown in FIG. 3.

In some embodiments, the anti-rotational device 112 and valve 24 are integrated to form a single down-hole tool 100. In some embodiments, a plurality of anti-rotational wings 122 are disposed on the outer surface 120 of the tubular housing 114. In some embodiments, the plurality of anti-rotational wings 122 are substantially equally spaced about the outer surface 120 of the tubular housing 114.

Referring still to FIGS. 5-6, a reactivation device 134 may be provided with means for axially engaging an axial surface of the borehole 136, the reactivation device 134 affixed to the first end 116 of the tubular housing 114. In some forms, the means for axially engaging an axial surface of the borehole 136 of the reactivation device 134 comprises a plurality of teeth 138 for engaging bottom-hole cement.

In operation, the spring-loaded down-hole tool 100 is run in, with valve 24 in the closed position, in pressure test mode. At this point, a pressure test may be conducted. The anti-rotation wings 122 are initially held slightly away from the lower part of the spring-loaded down-hole tool 100 by springs 140. When the tubing string (not shown) is rotated clockwise, the inertia of the anti-rotation wings 122 causes them to expand radially outwards relative to the axis of rotation. The expanded anti-rotation wings 122 contact the sides of a production casing, and the plurality of teeth 150 of the anti-rotation wings 122 can bite into the casing.

In the event that the rotor (not shown) applies clockwise torque to the lower string, the plurality of casing teeth 150 will resist the torque so applied due to the plurality of casing teeth 150.

To close the plurality of teeth 150 and valve 24 for a pressure test, the tubing string is rotated counter-clockwise such that the plurality of teeth 150 release from the production casing. The tubing string is lowered such that the plurality of teeth 138 bite and hold the lower part of the tool in a stationary position. The spring-loaded down-hole tool 100 is then rotated counter-clockwise, which causes the valve 24 to close. A pressure test can then be conducted.

Figure 7:
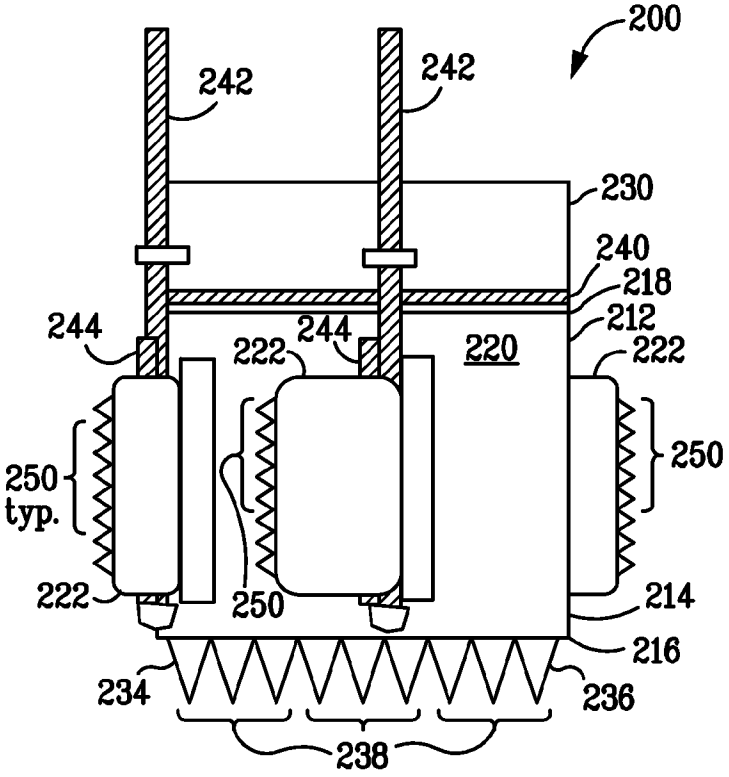
FIG. 7 presents a plan view of an illustrative example of a gear-driven down-hole tool for pressure testing production tubing, in pressure test mode, according to the present disclosure.

FIG. 7 presents a plan view of an illustrative example of a gear-driven down-hole tool 200 for pressure testing production tubing, in pressure test mode. The down-hole tool for pressure testing production tubing 200 includes an anti-rotational device 212. Anti-rotational device 212 includes a tubular housing 214 having a first end 216, a second end 218 and an outer surface 220. At least one anti-rotational wing 222 is disposed on the outer surface 220 of the tubular housing 214, the at least one anti-rotational wing radially extendable to engage a radial surface of the borehole to anchor the production tubing thereto. As shown, the at least one anti-rotational wing 222 may be provided with a plurality of casing teeth 250 to grip a casing when installed therein.

In some embodiments, the anti-rotational device 212 of gear-driven down-hole tool 200 includes a gear mechanism structured and arranged to extend the at least one anti-rotational wing 222 to engage a radial surface of the borehole Referring also to FIGS. 3 and 4, a valve 24 for controlling the flow of down-hole fluids within the production tubing may be provided. Valve 24 includes a first valve member 26 fixedly positioned within the tubular housing 214 of the anti-rotational device 212 and a second valve member 28 positionable between a closed position (see FIG. 3) and an open position (see FIG. 4). In some embodiments, the second valve member 28 is positioned adjacent the second end 218 of the tubular housing 214.

Figure 8:
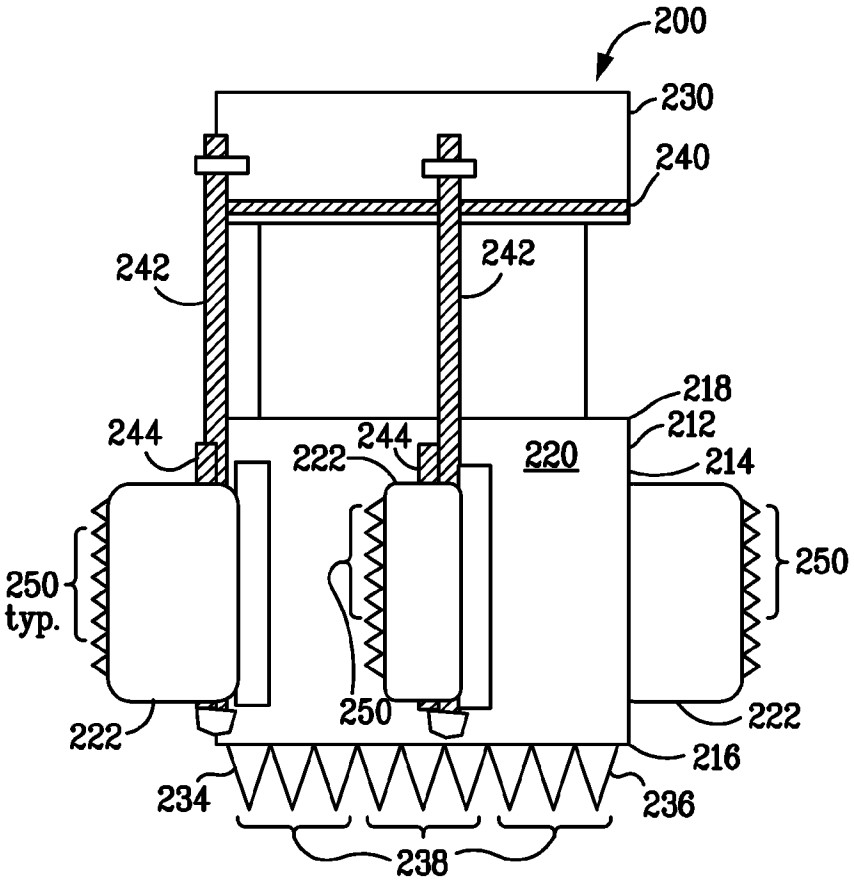
FIG. 8 presents a plan view of an illustrative example of a gear-driven down-hole tool for pressure testing production tubing, shown in production and anti-rotation mode, according to the present disclosure.

Referring now to FIG. 8, a plan view of an illustrative example of the gear-driven down-hole tool 200 for pressure testing production tubing is shown in production and anti-rotation mode. As may be appreciated, production tubing may be pressure tested when the valve 24 is in the closed position, as shown in FIG. 3.

In some embodiments, the anti-rotational device 212 and valve 24 are integrated to form a single down-hole tool 200. In some embodiments, a plurality of anti-rotational wings 222 are disposed on the outer surface 220 of the tubular housing 214. In some embodiments, the plurality of anti-rotational wings 222 are substantially equally spaced about the outer surface 220 of the tubular housing 214.

Referring still to FIGS. 7-8, a reactivation device 234 may be provided with means for axially engaging an axial surface of the borehole 236, the reactivation device 234 affixed to the first end 216 of the tubular housing 214. In some forms, the means for axially engaging an axial surface of the borehole 236 of the reactivation device 234 comprises a plurality of teeth 238 for engaging bottom-hole cement.

In operation, the gear-driven down-hole tool 200 is run in, with valve 24 in the closed position, in pressure test mode. At this point, a pressure test may be conducted. To switch to production mode, the tubing string (not shown) is set on bottom and the plurality of teeth 238 bite into the cement. The string is rotated clockwise, and the upper part 230 of the gear-driven down-hole tool 200 is separated from the lower part. This opens valve 24 and allows production fluids to pass through.

As the tubing string is rotated to the right, with the upper part of the gear-driven down-hole tool 200 moving and the lower portion held in place by the plurality of teeth 238, the wing-opening geared band 240 causes the wing-opening geared rods 242 to rotate counterclockwise (as viewed from the top of the borehole), which causes the wing gears to rotate clockwise, which causes the at least one anti-rotational wing 222 to rotate counterclockwise, and open. Advantageously, the gear-driven down-hole tool 200 may be geared such that when the valve 24 is in the fully open position, the at least one anti-rotational wing 222 contacts the side of the production casing, and the plurality of casing teeth 250 of the anti-rotational wings 222 can bite into the casing. As may be appreciated, in the event that the rotor applies clockwise torque to the lower string, the anti-rotational wings 222 will resist the torque applied due to the casing teeth plurality of casing teeth 250.

To close the anti-rotational wings 222 and valve 24 for a pressure test, weight is put on the string such that the plurality of teeth 238 bite and hold the lower part of the tool stationary. The tubing string is rotated counter-clockwise, which causes both the wings to close and the internal valve to close. A pressure test can then be conducted.

Figure 9:
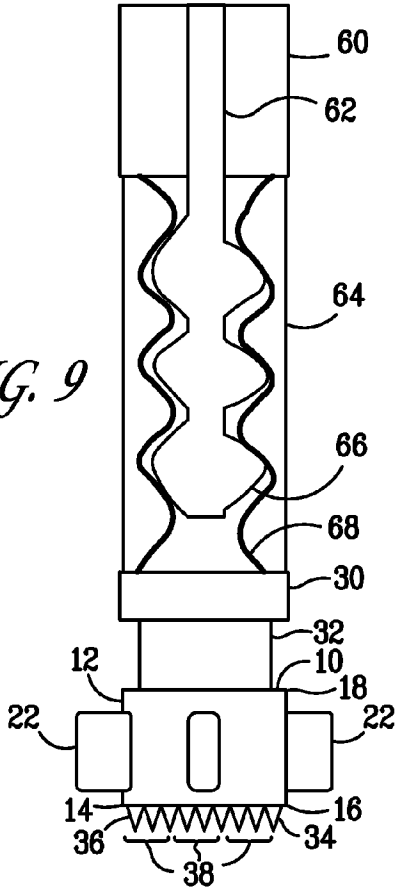
FIG. 9 presents a diagrammatic view of an illustrative example of a down-hole tool for pressure testing production tubing within a borehole of a well, shown in production and anti-rotation mode, in combination with a progressive cavity pump and production tubing and rotor rods, according to the present disclosure.

Referring now to FIG. 9, a diagrammatic view of an illustrative example of a down-hole tool 10 for pressure testing production tubing 60 within a borehole of a well, shown in production and anti-rotation mode, in combination with a progressive cavity pump 64 and production tubing 60. As shown, progressive cavity pump 64 includes a rotor 66 and a stator 68. Rotor 66 is connected to rotor rod 62, as is conventional. In some forms, threaded valve housing 30 of down-hole tool 10 is connected to stator 68 by any suitable means. A reactivation device 34 is provided with means for axially engaging an axial surface of the borehole 36, the reactivation device 34 affixed to the first end 16 of the tubular housing 14. In some forms, the means for axially engaging an axial surface of the borehole 36 of the reactivation device 34 comprises a plurality of teeth 38 for engaging bottom-hole cement.

As shown, a plurality of anti-rotational wings 22 are disposed on the outer surface 20 of the tubular housing 14, the plurality of anti-rotational wings 22 radially extendable to engage a radial surface of the borehole to anchor the production tubing 60 thereto. Referring again to FIGS. 3 and 4, valve 24 is activated and deactivated by rotating a threaded valve housing 30, threaded valve housing 30 provided with an external threaded section 32 for mating with an internal threaded section (not shown) of tubular housing 14. As indicated above, the production tubing 60 may be pressure tested when the valve 24 is in the closed position, as shown in FIG. 3.

Figure 10:
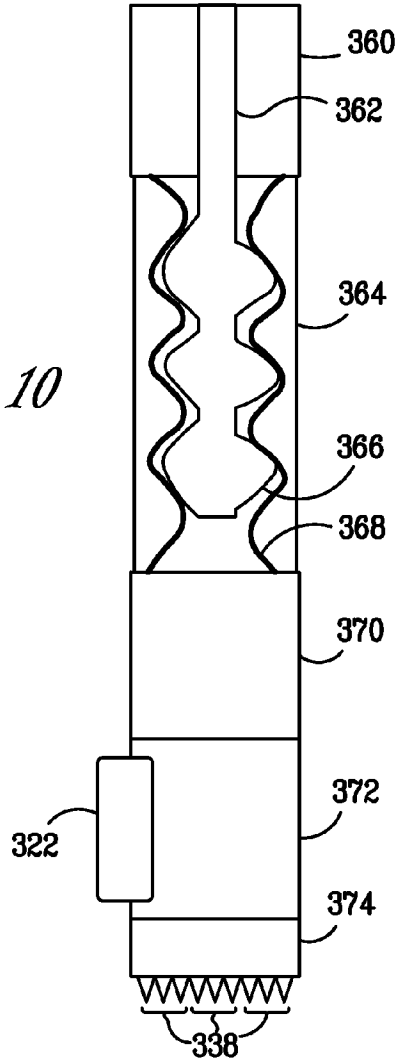
FIG. 10 presents a diagrammatic view of an illustrative example of a down-hole tool for pressure testing production tubing within a borehole of a well, shown with a commercial anti-rotation tool, in combination with a progressive cavity pump and production tubing and rotor rods, according to the present disclosure.

FIG. 10 presents a diagrammatic view of an illustrative example of an alternative embodiment of a down-hole tool assembly 300 for pressure testing production tubing within a borehole of a well. The down-hole tool assembly 300 utilizes a commercial anti-rotation tool 372, available from a variety of commercial sources. Down-hole tool assembly 300 is shown in combination with a progressive cavity pump 364 and production tubing 360.

Figure 13:
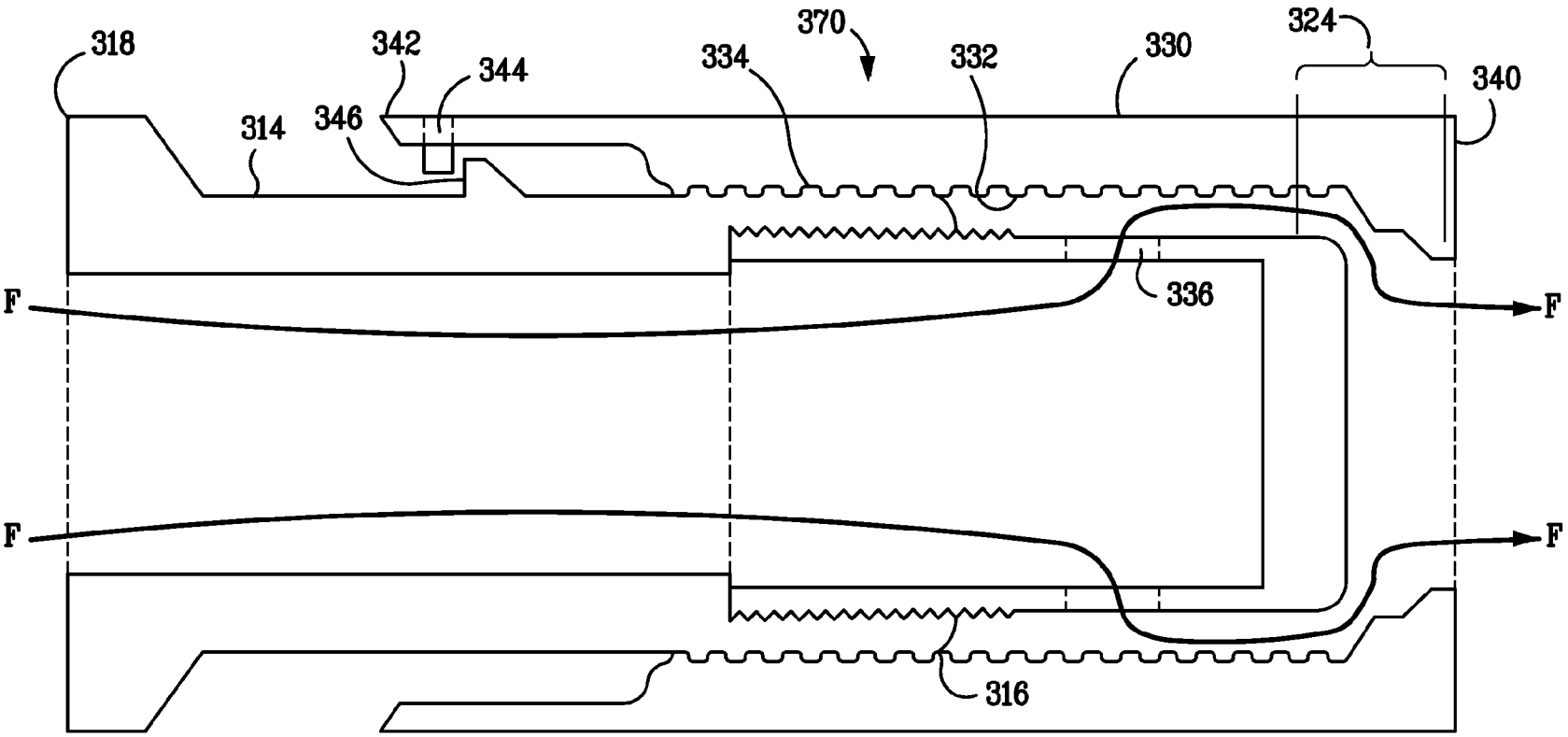
FIG. 13 presents a cross-sectional view of an illustrative example of a down-hole tool for pressure testing production tubing within a borehole of a well, of the type depicted in FIG. 10, according to the present disclosure.

Referring also to FIG. 13, valve unit 370 is provided to enable the pressure testing of production tubing 360. Valve unit 370 may be provided with a valve 324, structured and arranged to function in the manner depicted. Valve 324 is shown in the open position, permitting production fluids to pass through port 336 of valve unit 370, as depicted by flow lines F. Valve 324 is activated and deactivated by rotating an upper threaded valve housing 330, upper threaded valve housing 330 provided with an internal threaded section 332 for mating with an internal threaded section 334 of lower tubular housing 314. Lower tubular housing 314 has a first end 316, and a second end 318; second end 318 structured and arranged to connect to a commercial anti-rotation tool 372 (see FIG. 10).

Upper threaded valve housing 330 has a first end 340, and a second end 342, first end 340 structured and arranged to connect to a progressive cavity pump 364 (see FIG. 10). Second end 342 is provided with a rotational back-out prevention tab 344 for mating with tab 346 of lower tubular housing 314.

As may be appreciated, the production tubing 360 may be pressure tested when the valve 324 is in the closed position. In some embodiments, valve 324 for controlling the flow of down-hole fluids employs a metal-to-metal seal. In other embodiments, valve 324 employs an O-ring seal (not shown) or seals of material other than metal (not shown).

As shown, progressive cavity pump 364 includes a rotor 366 and a stator 368. Rotor 366 is connected to rotor rod 362, as is conventional. In some forms, valve unit 370 of down-hole tool assembly 300 is connected to stator 368 by any suitable means.

A reactivation device 374 is provided with means for axially engaging an axial surface of the borehole 336, the reactivation device 374 affixed to one end of the commercial anti-rotation tool 372. In some forms, the means for axially engaging an axial surface of the borehole 336 of the reactivation device 374 comprises a plurality of teeth 338 for engaging bottom-hole cement.

Figure 11:
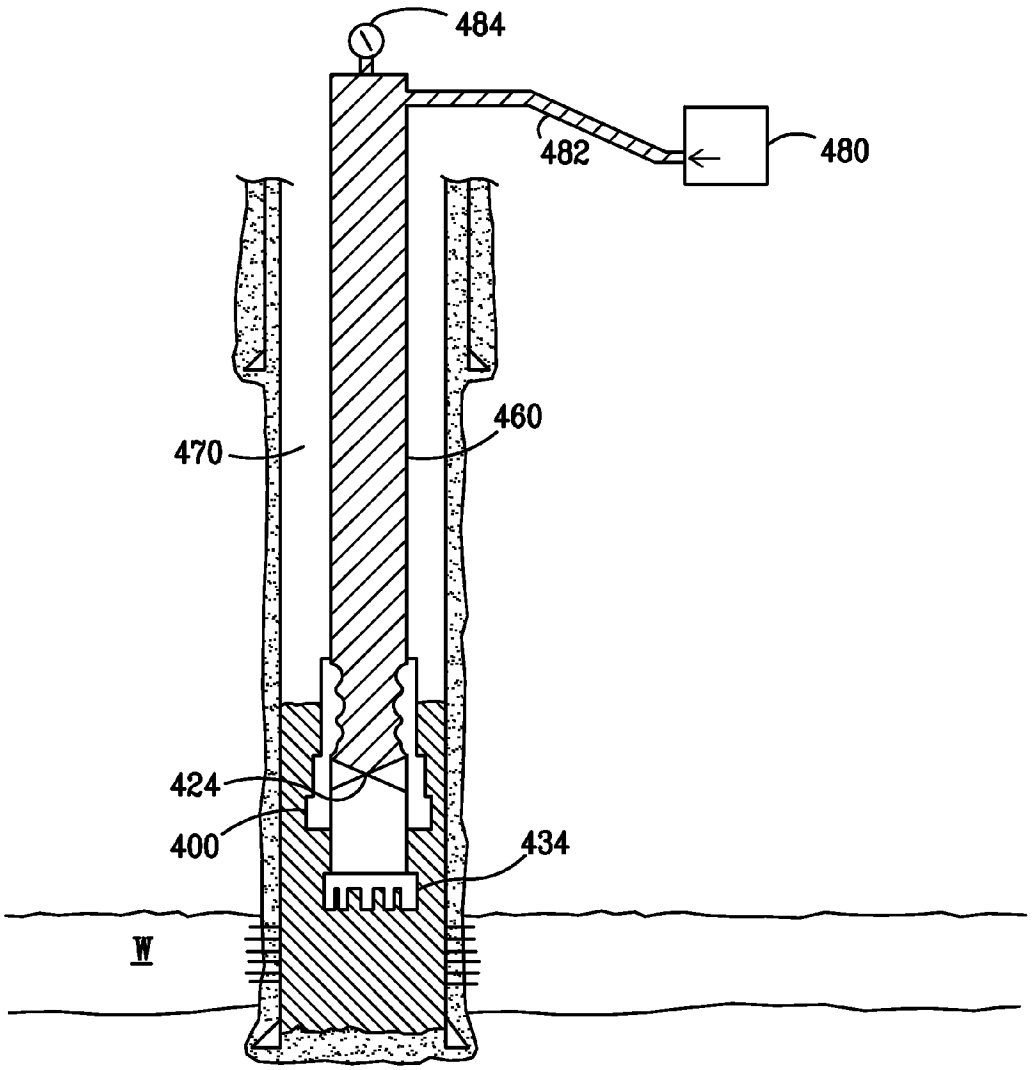
FIG. 11 presents a diagrammatic view of an illustrative, non-exclusive example of a down-hole tool for pressure testing production tubing within a borehole of a well, in pressure test mode, according to the present disclosure.

FIG. 11 presents a diagrammatic view of an illustrative, non-exclusive example of a down-hole tool 400 for pressure testing production tubing 460 within a borehole 470 of a well W, in pressure test mode. In this phase of operation, the production tubing 460 is run in hole with the stator 468 and down-hole tool 400 attached. A valve 424 is placed in the closed position for pressure testing. A pressure test is conducted by pressurizing the system using a pump 480, which is placed in fluid communication with production tubing 460, for example, using tubing 482. A pressure gage 484 may be used to provide information concerning the pressure integrity of the production tubing 460. A wide variety of gages, pressure transducers, or the like may be employed during testing.

As shown, a reactivation device 434 may be provided to assist in returning the system to pressure-test mode, as described above. Reactivation device 434 is provided with means for axially engaging an axial surface of the borehole 436, the reactivation device 434 affixed to a first end 416 of the tubular housing 414. In some forms, the means for axially engaging an axial surface of the borehole 436 of the reactivation device 434 comprises a plurality of teeth 438 for engaging bottom-hole cement.

Figure 12:
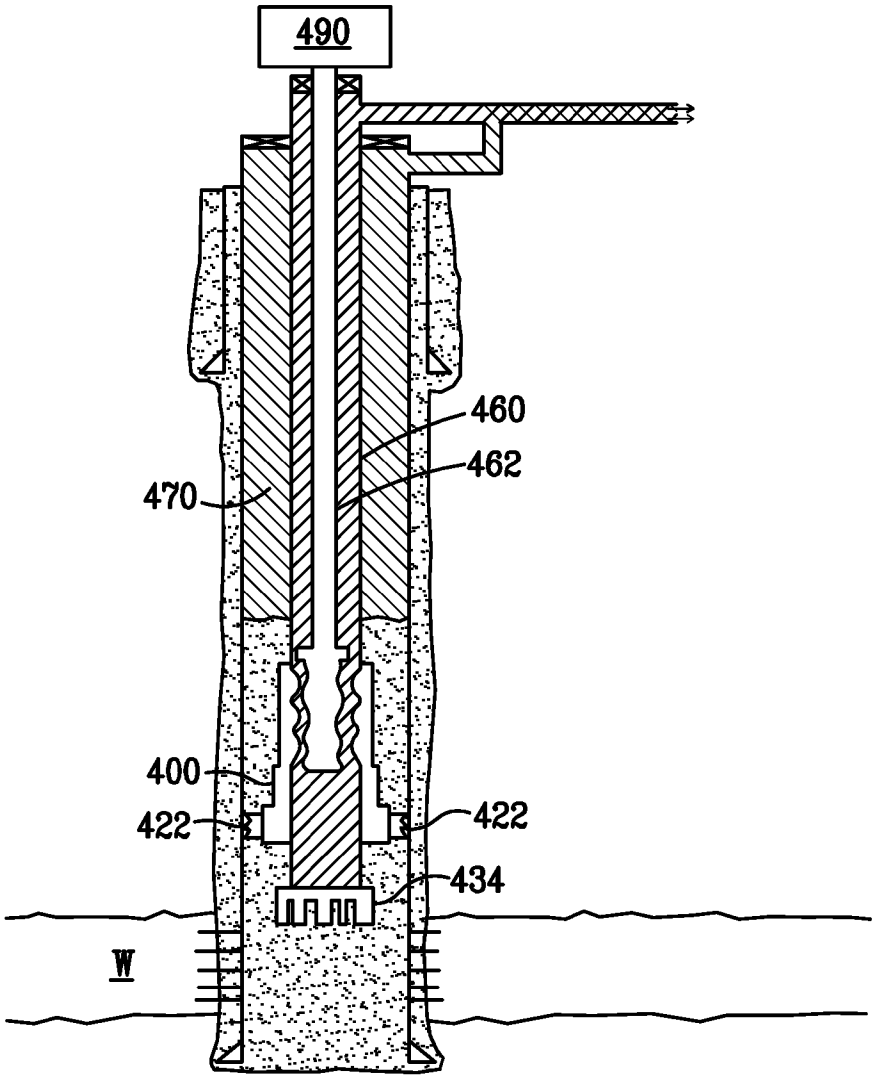
FIG. 12 presents a plan view of an illustrative example of the down-hole tool for pressure testing production tubing within a borehole of a well of FIG. 11, shown in production and anti-rotation mode, according to the present disclosure.

FIG. 12 presents a plan view of an illustrative example of down-hole tool 400 for pressure testing production tubing 460 within a borehole 470 of a well W, shown in production and anti-rotation mode, according to the present disclosure. In production mode, motor 490 turns rod 462, which is positioned within production tubing 460, and connected to rotor 466 of progressive cavity pump 464.

To go from the pressure test mode of operation, depicted in FIG. 11, to the production mode depicted in FIG. 12, the production tubing 460, stator 468 and down-hole tool 400 assembly is rotated clockwise, as viewed from the surface of the well W. The clockwise rotation causes the following: the plurality of anti-rotational wings 422 are engaged; the threaded valve housing 430 and tubular housing 414 of down-hole tool 400 separate, for example, by left-handed clearance thread; and the internal valve 424 (see FIG. 11) is opened as the threaded valve housing 430 and tubular housing 414 of the down-hole tool 400 separate.

The valve 424 can be re-closed to perform a future pressure test by releasing the plurality of anti-rotational wings 422 and tagging the cement at the bottom of the hole with reactivation device 434. The plurality of teeth 438 are used to dig into the bottom-hole cement allowing counter-clockwise rotation to be applied to re-close the valve 424.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A down-hole tool for pressure testing production tubing within a borehole of a well and returning the well to production, comprising:

(a) an anti-rotational device comprising a tubular housing having a first end, a second end, an outer surface, and a plurality of anti-rotational wings disposed on the outer surface of the tubular housing and substantially equally spaced about the outer surface of the tubular housing, the at least one anti-rotational wing radially extendable to engage a radial surface of the borehole to anchor the production tubing thereto;

(b) a valve for controlling the flow of down-hole fluids within the production tubing, the valve comprising a first valve member fixedly positioned within the tubular housing of the anti-rotational device and a second valve member positionable between a closed position and an open position; and (c) a reactivation device comprising means for axially engaging an axial surface of the borehole, the reactivation device affixed to the first end of the tubular housing, wherein the production tubing may be pressure tested when the valve is in the closed position.

2. The down-hole tool of claim 1, wherein the second valve member is positioned adjacent the second end of the tubular housing.

3. The down-hole tool of claim 2, wherein the anti-rotational device and valve are integrated to form a single down-hole tool.

4. The down-hole tool of claim 1, wherein the plurality of anti-rotational wings are biased to extend the plurality of anti-rotational wings to engage the radial surface of the borehole.

5. The down-hole tool of claim 1, wherein the anti-rotational device further comprises a gear mechanism structured and arranged to extend the plurality of anti-rotational wings to engage the radial surface of the borehole.

6. The down-hole tool of claim 1, wherein the down-hole tool is attached to a stator of a progressive cavity pump.

7. The down-hole tool of claim 1, wherein the down-hole tool is attached to a non-perforated tubular extension, the non-perforated tubular extension attached to the bottom of the stator of a progressive cavity pump.

8. The down-hole tool of claim 1, wherein the valve for controlling the flow of down-hole fluids of the down-hole tool is rotated to place the valve in a closed position.

9. The down-hole tool of claim 1, wherein the valve for controlling the flow of down-hole fluids of the down-hole tool is rotated in an opposite direction from that employed to close the valve to place the valve in an open position.

10. The down-hole tool of claim 1, wherein the means for axially engaging an axial surface of the borehole of the reactivation device comprises a plurality of teeth for engaging bottom-hole cement.

11. A method for pressure testing production tubing within a borehole of a well and returning the well to production, the method comprising:

(a) installing a production tubing string within a borehole of a well, the tubing string comprising a down-hole tool positioned adjacent a distal end of a production tubing string, the down-hole tool comprising: (i) an anti-rotational device comprising a tubular housing having a first end, a second end, an outer surface and a plurality of anti-rotational wings disposed on the outer surface and substantially equally spaced about the outer surface of the tubular housing, the at least one anti-rotational wing radially extendable to engage a radial surface of the borehole to anchor the production tubing thereto; (ii) a valve for controlling the flow of down-hole fluids within the production tubing, the valve comprising a first valve member fixedly positioned within the tubular housing of the anti-rotational device and a second valve member positionable between a closed position and an open position; and (iii) a reactivation device comprising means for axially engaging an axial surface of the borehole, the reactivation device affixed to the first end of the tubular housing;

(b) conducting a pressure test of the production tubing string; and (c) returning the well to production upon verifying tubing integrity.

12. The method of claim 11, wherein step (c) further comprises the steps of:

(i) rotating the down-hole tool to extend the at least one wing and engage a radial surface of the borehole to anchor the production tubing thereto; and (ii) rotating the down-hole tool to open the valve to allow production fluids to flow from the distal end to the proximal end of the production tubing string.

13. The method of claim 11, wherein the following steps are conducted prior to conducting step (b):

rotating the down-hole tool to retract the at least one wing and disengage the radial surface of the borehole;

(ii) lowering the production tubing string to engage the reactivation device with an axial surface of the borehole, and (ii) rotating the down-hole tool to close the valve to seal the production tubing string from production fluids.

14. The method of claim 11, wherein the second valve member is positioned adjacent the second end of the tubular housing.

15. The method of claim 11, wherein the plurality of anti-rotational wings are biased to extend the plurality of anti-rotational wings to engage the radial surface of the borehole.

16. The method of claim 11, wherein the anti-rotational device further comprises a gear mechanism structured and arranged to extend the plurality of anti-rotational wings to engage the radial surface of the borehole.

17. The method of claim 11, wherein the down-hole tool is attached to a stator of a progressive cavity pump.

18. The down-hole tool of claim 11, wherein the down-hole tool is attached to a non-perforated tubular extension, the non-perforated tubular extension attached to the bottom of the stator of a progressive cavity pump.

19. The method of claim 11, wherein the means for axially engaging an axial surface of the borehole of the reactivation device comprises a plurality of teeth for engaging bottom-hole cement.

20. The method of claim 11, wherein the anti-rotational device and valve are integrated to form a single down-hole tool.

21. The method of claim 11, wherein the anti-rotational device and valve form an assembly.

* * * * *